US006210071B1

(12) United States Patent
McSharry

(10) Patent No.: US 6,210,071 B1
(45) Date of Patent: Apr. 3, 2001

(54) METHOD AND APPARATUS FOR CUTTING RUMBLE STRIPS IN A ROADWAY

(75) Inventor: Chris McSharry, Ooltewah, TN (US)

(73) Assignee: Astec Industries, Inc., Chattanooga, TN (US)

( * ) Notice: Subject to any disclaimer, the term of this patent is extended or adjusted under 35 U.S.C. 154(b) by 0 days.

(21) Appl. No.: 09/406,390

(22) Filed: Sep. 27, 1999

(51) Int. Cl.[7] ..... E01C 23/16

(52) U.S. Cl. ..... 404/94; 404/75; 404/90; 299/39.4

(58) Field of Search ..... 404/75, 89, 90, 404/93, 94, 122, 124, 129; 175/313; 299/39.1, 39.4, 39.2, 39.5, 39.6

(56) References Cited

U.S. PATENT DOCUMENTS

| | | | | |
|---|---|---|---|---|
| 4,175,886 | * | 11/1979 | Moench et al. | 404/90 |
| 4,325,580 | * | 4/1982 | Swisher, Jr. et al. | 404/90 |
| 4,342,485 | | 8/1982 | Tuneblom . | |
| 4,697,850 | * | 10/1987 | Tuneblom | 299/87 |
| 4,755,001 | | 7/1988 | Gilbert . | |
| 4,764,051 | | 8/1988 | Whitney . | |
| 5,078,540 | * | 1/1992 | Jakob et al. | 404/90 |
| 5,215,071 | | 6/1993 | Mertes et al. . | |
| 5,297,894 | | 3/1994 | Yenick . | |
| 5,391,017 | | 2/1995 | Thomas et al. . | |
| 5,415,495 | | 5/1995 | Johnson . | |
| 5,456,547 | | 10/1995 | Thomas et al. . | |
| 5,484,228 | | 1/1996 | Thomas et al. . | |
| 5,582,490 | * | 12/1996 | Murray | 404/94 |
| 5,639,180 | * | 6/1997 | Sulosky et al. | 404/93 |
| 5,676,490 | * | 10/1997 | Nelson | 404/94 |
| 5,722,789 | * | 3/1998 | Murray et al. | 404/90 |
| 5,860,764 | * | 1/1999 | Roberts | 404/93 |
| 5,957,620 | * | 9/1999 | Thomas et al. | 404/94 |

OTHER PUBLICATIONS

J. Don Brock, PhD., P.E.; Technical Paper T–127 Milling & Recycling: Apr. 1994, pp. 1–23; Astec Industries, Inc.; Chattanooga, TN.

Technical Specification—RX 20 Cold Planer, Astec Industries, Inc. Chattanooga, TN No Date.

* cited by examiner

*Primary Examiner*—Thomas B. Will
*Assistant Examiner*—Kristine M. Markovich
(74) *Attorney, Agent, or Firm*—Chambliss, Bahner & Stophel, P.C.

(57) ABSTRACT

A method and an apparatus are disclosed for cutting rumble strips in the surface of a roadway. The apparatus is a self-propelled machine which includes a frame and a drive mechanism mounted to the frame and adapted for advancing the machine across the surface of the roadway. The machine also includes a generally cylindrical cutting drum that is mounted on the frame for rotation about an axis that is disposed generally parallel to the surface of the roadway. A plurality of cutting teeth are mounted on the outer surface of the drum in a predetermined pattern, and a mechanism is provided for rotating the cutting drum about its axis. The drum is maintained at a predetermined position with respect to the surface of the roadway so that the cutting teeth will cut into said surface a relatively constant, predetermined depth as the drum is rotated about its axis while the machine is advanced along the surface of the roadway. When the drum is rotated about its axis while being maintained at the predetermined position with respect to the surface of the roadway as the machine is advanced therealong, the cutting teeth will cut a series of spaced parallel rumble strips into the surface of the roadway. This improved machine is capable of smooth and uninterrupted cutting operation while advancing along the surface of the roadway at greater speeds and without the vibration that is characteristic of other known machines.

17 Claims, 5 Drawing Sheets

METHOD AND APPARATUS FOR CUTTING RUMBLE STRIPS IN A ROADWAY

FIELD OF THE INVENTION

The present invention relates to the cutting of rumble strips into the surface of a roadway, most commonly a highway or a highway shoulder, primarily for the purpose of alerting a driver to a potential danger or change in conditions ahead.

BACKGROUND OF THE INVENTION

Rumble strips or sound noise alert patterns (SNAP) may be cut into the surface of a roadway in order to awaken or alert a driver of a vehicle that has strayed out of the lane of travel and is in danger of running off the road. As a vehicle's tires travel across the rumble strips in the surface of the roadway, a significant vibration is created which may be both felt and heard by the driver. Rumble strips are most commonly found along the edge or shoulder of roadways; however, they may also be found in the lane of travel itself where their intended function is to alert the driver of an impending change in conditions such as a construction area or a toll plaza just ahead.

Due to the advantage that rumble strips provide in awakening or alerting drivers and preventing potential accidents, it is desirable that roadways designed for high-speed travel include rumble strips in their shoulders. However, many roads and highways do not have rumble strips, and among the reasons for their limited use may be the time and expense required to cut them by conventional means. Many of the devices that are designed for the cutting of rumble strips include cutting assemblies, either cutting drums or one or more cutting disks, that must be raised after cutting of one rumble strip, to permit the device to move or be moved into position for cutting of the next rumble strip. Thus, for example, U.S. Pat. No. 5,215,071 of Mertes et al., U.S. Pat. No. 5,415,495 of Johnson and U.S. Pat. No. 5,456,547 of Thomas et al. describe pavement cutting devices that include a cutting assembly that is raised and lowered by a hydraulic lift mechanism. Other devices, such as those of U.S. Pat. No. 5,297,894 of Yenick and U.S. Pat. No. 5,484,228 of Thomas et al. include a rotating cam-shaped member that, by virtue of its shape, raises and lowers the cutting assembly as it rotates. When the assembly is raised, it clears the pavement, and when it is lowered by rotation of the cam, it cuts a rumble strip. In a similar arrangement described in U.S. Pat. No. 5,391,017 of Thomas et al., the cutting assembly is raised and lowered by rotation of an eccentrically mounted roller.

While some of these devices, such as those described in U.S. Pat. No. 5,297,894 of Yenick, U.S. Pat. No. 5,391,017 of Thomas et al., U.S. Pat. No. 5,415,495 of Johnson and U.S. Pat. No. 5,484,228 of Thomas et al. may be operated to cut rumble strips while the machine is moving along the roadway, such devices can typically operate only at extremely limited speeds. In addition, some of the rumble strip machines that utilize rotating multi-faceted cams or eccentrically-mounted rollers to raise and lower the cutting head also utilize the cams or rollers as the wheels upon which the machine rolls along the surface of the roadway. In such an arrangement, the entire machine will be raised and lowered as the cams or eccentrically-mounted rollers rotate to raise and lower the cutting head with respect to the roadway. This significantly limits the speed at which the device may travel along the roadway, and it creates vertical motion that is uncomfortable for the operator and imposes significant stresses on the machine.

The present invention provides an alternative which allows for a self-propelled rumble strip cutter which may be operated while moving smoothly along the roadway at a steady pace and which is considerably quicker and more efficient than other known machines or those currently available.

OBJECTS OF THE INVENTION

It is an object of the present invention to provide a method for cutting rumble strips in the surface of a roadway. It is another object of the present invention to provide a rumble strip cutting machine which is capable of operating while moving smoothly along the roadway at speeds which are significantly faster than may be obtained using known alternatives or devices currently available. It is yet another object of the invention to provide a rumble strip cutting machine which may be operated to cut a series of rumble strips without requiring that the cutting assembly be raised after the cutting of one rumble strip, to permit the device to move or be moved into position for cutting of the next rumble strip. It is a further object of the present invention to provide a method and apparatus for cutting rumble strips which minimizes vibration so as to improve the efficiency and operator comfort over that obtainable with rumble strip machines which have multi-faceted cams or eccentrically mounted driving or follower wheels.

Additional objects and advantages of this invention will become apparent from an examination of the drawings and the ensuing description.

EXPLANATION OF TECHNICAL TERMS

As used herein, the term rumble strip refers to one of a series of spaced, generally parallel grooves or depressions in the surface of a roadway, which are created by cutting, grinding or impressing the surface of the roadway in a pattern designed to alert a driver of a vehicle to a potential danger or change in conditions ahead.

As used herein, the term roadway refers to the hard surface of a road, street, boulevard, avenue or highway (including an interstate highway) that is intended for vehicular traffic. The term includes the traffic lanes, medians and paved edges or shoulders that may be accessible to a vehicle.

SUMMARY OF THE INVENTION

A self-propelled machine for cutting rumble strips in the surface of a roadway and which comprises an improvement over known and currently available machines is provided. The invention will allow the operator to cut rumble strips into the surface of a roadway while moving along the roadway at a pace comparable to that of a standard milling or planing machine. The present invention has a generally cylindrical cutting drum mounted on a frame for rotation about an axis that is disposed generally parallel to the surface of a roadway. The apparatus also includes means for rotating the drum and means for maintaining the cutting drum at a predetermined position with respect to the roadway. A drive means is also mounted on the frame for advancing the machine across the surface of the roadway. The cutting drum has cutting teeth arranged in a predetermined pattern around the drum so that when the machine is advanced across the surface of the roadway while the drum is rotated about its axis, the cutting teeth will cut a series of spaced parallel rumble strips into the surface of the roadway. In the preferred embodiment, the cutting teeth are arranged in an interrupted helical pattern on the cylindrical drum. The invention also contemplates a change in the pattern of arrangement of the cutting teeth and/or in the orientation of the axis of the rotation of the drum with respect to the direction of the travel of the machine along the roadway so that the orientation of the rumble strips with respect to the direction of travel along the roadway may be changed.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DETAILED DESCRIPTION OF THE INVENTION

Figure 1:
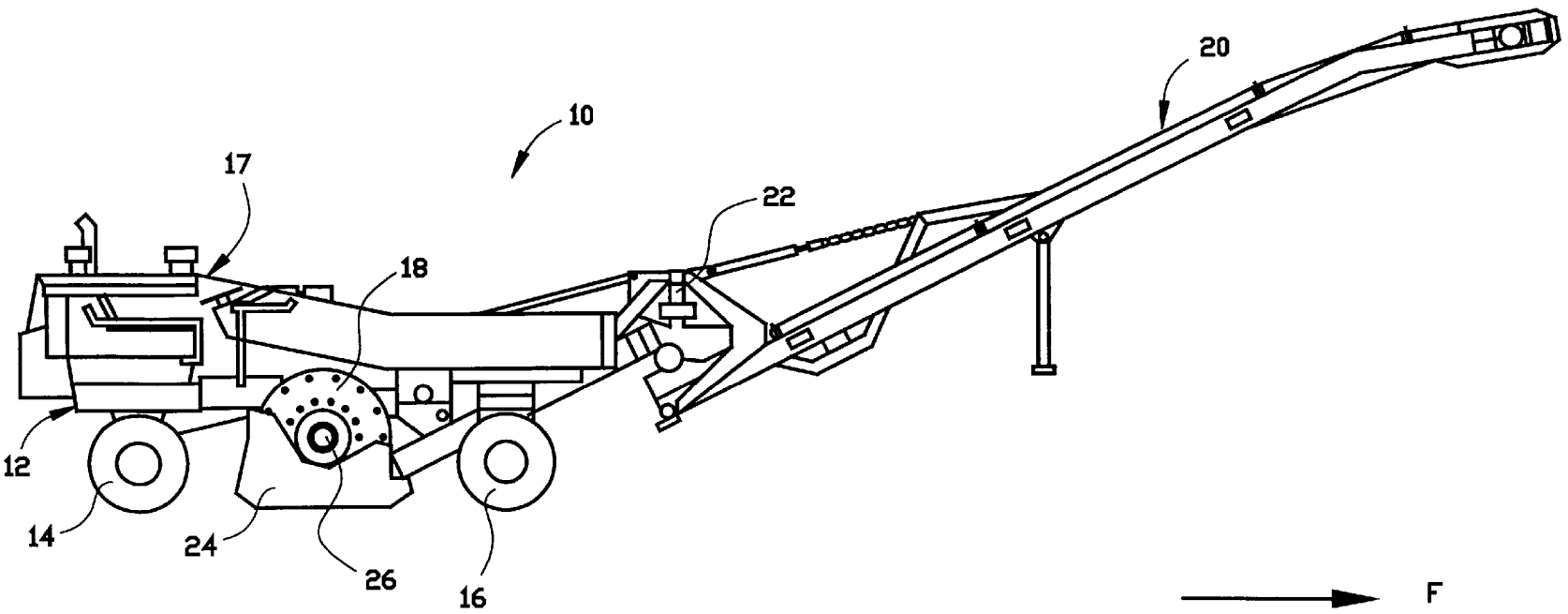
FIG. 1 is a side view of a preferred embodiment of the invention.
Figure 2:
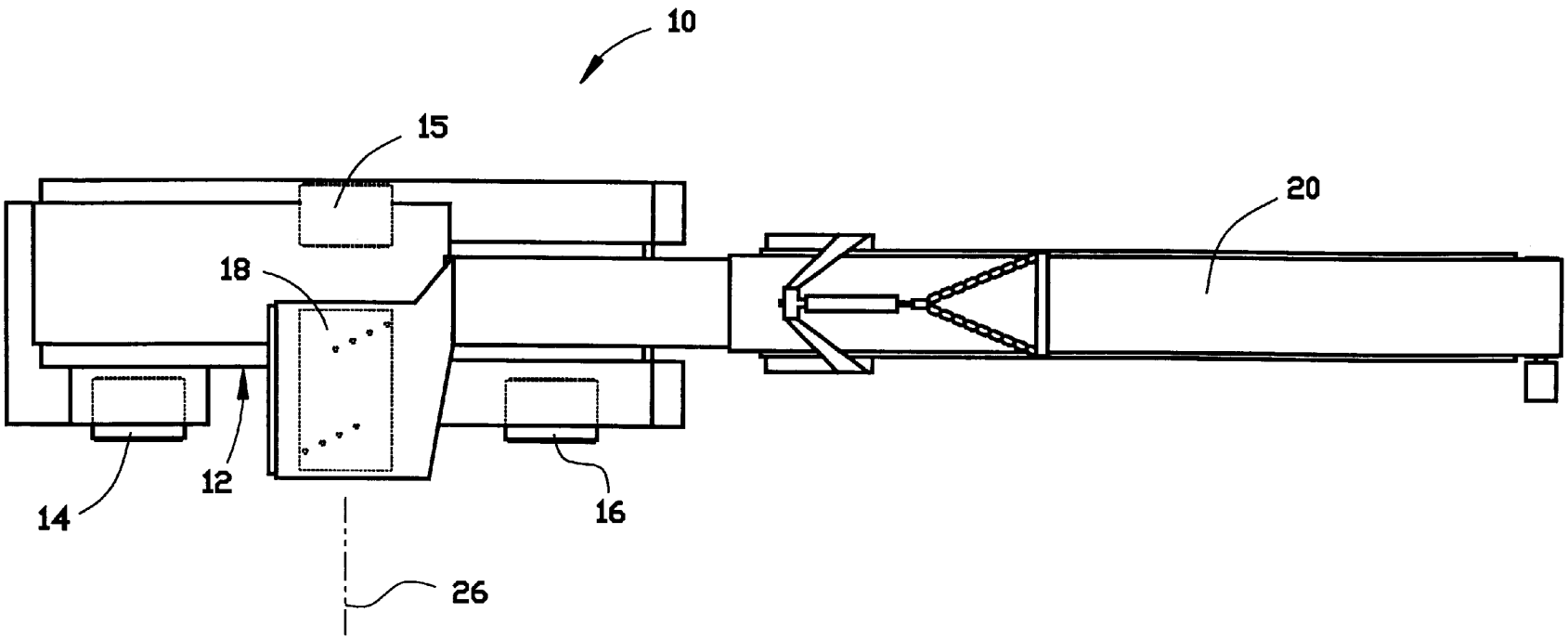
FIG. 2 is a top view of the machine of FIG. 1.

The present invention provides a quicker and more efficient means of cutting rumble strips into roadway surfaces. FIGS. 1 and 2 illustrate a preferred embodiment of the invention, which is similar to a standard milling or planing machine. In fact, the invention may be comprised of a standard milling or planing machine which has been modified primarily by replacing the standard milling drum with the drum of the invention. Rumble strip cutting machine 10 includes chassis or frame 12 and drive means (not shown) mounted to the frame which is adapted for advancing machine 10 across the surface of a roadway by transfer of motive power to drive wheels 14, 15 (see FIG. 2) and 16. Preferably, the drive means includes a diesel engine and a hydrostatic all-wheel planetary drive system, although other drive means as are known or which may be subsequently developed may also be used. In the preferred embodiment of FIGS. 1 and 2, wheels 14 and 16 are steerable. Although machine 10 includes drive wheels 14, 15 and 16 for use in driving or advancing machine 10 across the roadway, a track-drive system (not shown) may be used in the alternative. Still another embodiment of the invention (not shown) could include four wheels, two mounted on an axle at the rear and the other two mounted for steering at the front. Yet another embodiment could include two sets of drive track, one mounted on each side of the machine, or four sets of drive track, one located in each corner of the frame, so that the operator could adjust the speed or direction of the drive tracks on one side of the machine to cause the machine to turn.

Machine 10 also includes operator's station 17 with suitable machine controls and cutting drum 18. Since machine 10 is a conventional planing or milling machine which has been modified primarily by the substitution of drum 18 for the conventional drum, the machine is also equipped with conveyor 20. Conveyor 20 may be raised or lowered in a conventional manner and pivoted about axis 22 to swing from side to side. In the conventional planing or milling operation, conveyor 20 may be used to convey cuttings removed from the surface of the roadway to a truck for disposal. The conveyor may also be activated according to the invention for a similar purpose, or, since the volume of cuttings from the cutting of rumble strips is considerably less than from a conventional milling or planing operation, the conveyor may be left idle, which will result in the cuttings from the rumble strips remaining in the roadway. A sweeper or vacuum (not shown) may be located on the rear of machine 10, pulled behind it, or provided in an apparatus that is separately driven, if desired to remove material obtained from the cutting of rumble strips. Cutting drum guard 24 helps to insure that material cut from the roadway will not be scattered.

The generally cylindrical cutting drum 18 is mounted on frame 12, and means are provided (not shown) for rotating the cutting drum about axis 26 that is disposed generally parallel to the surface of the roadway. When machine 10 is driven in the forward direction along the roadway (as shown by arrow F in FIG. 1), drum 18 is preferably rotated in the clockwise direction. Conventional milling machine leveling devices (not shown) or other suitable means are provided to maintain cutting drum 18 at a predetermined position with respect to the surface of the roadway so that cutting teeth 28 (see FIGS. 3 through 5) will cut into said surface a relatively constant, predetermined depth as the drum 18 is rotated about its axis 26 while machine 10 is advanced along the surface of the roadway. It is not contemplated or necessarily desirable that the depth of each rumble strip be constant across its width. In fact, the depth of each rumble strip may vary across its width, with the deepest point being located at the center. However, it is desirable that each rumble strip be cut to essentially the same predetermined depth as each other. Preferably, hydraulic or other means are provided (although not shown) for moving cutting drum 18 upwardly and out of contact with the surface of the roadway in order to move the machine into position to begin the cutting of rumble strips, and downwardly to bring the cutting drum to the predetermined position with respect to the surface of the roadway for cutting to begin.

Figure 3:
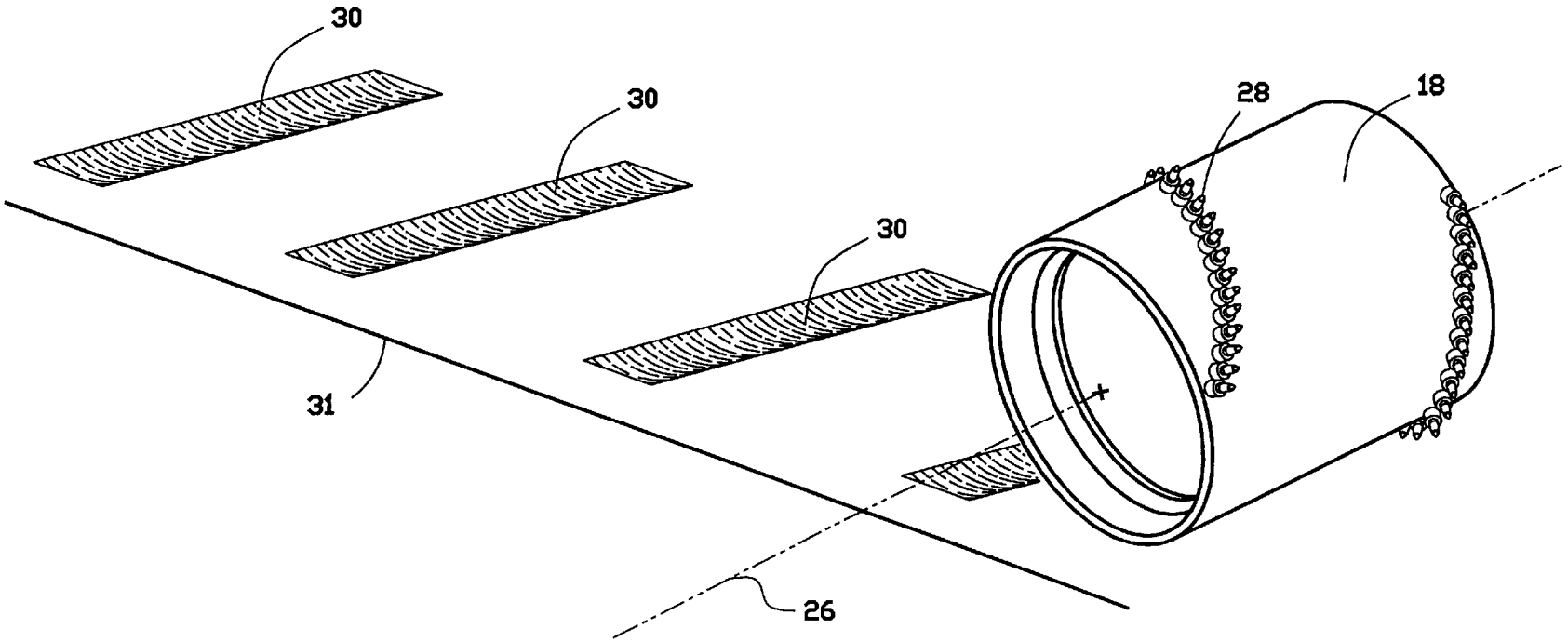
FIG. 3 is a perspective view of a cutting drum that comprises a part of the invention, with the cutting teeth arranged in an interrupted helical pattern, the preferred embodiment.

FIG. 3 shows a generally cylindrical cutting drum 18, having a plurality of cutting teeth 28 mounted on the outer surface thereof. Cutting teeth 28 are preferably comprised of a highly wear resistant steel body that is tipped with a tungsten carbide insert, or an equivalent, for best performance. The cutting teeth used may be the same cutting teeth as those used in a conventional milling or planing machine.

Cutting teeth 28 are arranged in a predetermined pattern around drum 18. The pattern is selected, along with the size, direction and speed of rotation of the drum and the speed of advancement of the machine along the roadway, to produce a series of rumble strips 30 without requiring that the drum be raised to clear the pavement between the strips and lowered into contact with the surface of the roadway at the location of each strip. The preferred pattern, shown in FIG. 3, is an interrupted helical pattern, although cutting teeth 28 may be arranged in a variety of patterns which may be configured to cut a series of spaced parallel, rumble strips when the drum 18 is rotated about its axis while being maintained at a predetermined position with respect to the surface of the roadway.

Drum 18 may be provided in a variety of lengths and diameters, and teeth 28 may be provided thereon in such numbers and patterns that rumble strips of any desired width and length may be produced. In addition to the length and diameter of drum 18 and the number, arrangement and positioning of cutting teeth 28, the rate of rotation of drum 18 about axis 26 with respect to the speed of machine 10 can be adjusted to produce rumble strips of any convenient spacing. It is contemplated that drum 18 and cutting teeth 28 may be provided in any convenient size and configuration, including that which will permit the cutting of rumble strips of up to approximately forty inches in length. In the preferred embodiment of the invention, drum 18, having a length of 40 inches and a diameter of 31.5 inches (when measured from tip to tip of the cutting teeth), and including 37 teeth arranged in the pattern of FIG. 3, may be rotated at a rate of 160 revolutions per minute while the machine is advanced along the roadway in the direction F at a speed of 160 feet per minute to cut rumble strips 30 in the pattern illustrated. Such rumble strips are preferably approximately five inches wide, 18 inches in length, and are spaced approximately one foot apart.

In addition, the pattern of teeth 28 and the angle of axis 26 with respect to the direction of forward travel of the machine may be selected to orient the rumble strips at any desired angle with respect to the direction of travel or with respect to the edge 31 (see FIGS. 3 through 5) of the roadway. In the preferred embodiment of FIG. 3, the pattern of the teeth and the angle of axis 26 have been selected to orient the rumble strips cut into the surface of the roadway at an angle with respect to the direction of travel F (see FIG. 1) of approximately 30–40°.

Figure 4:
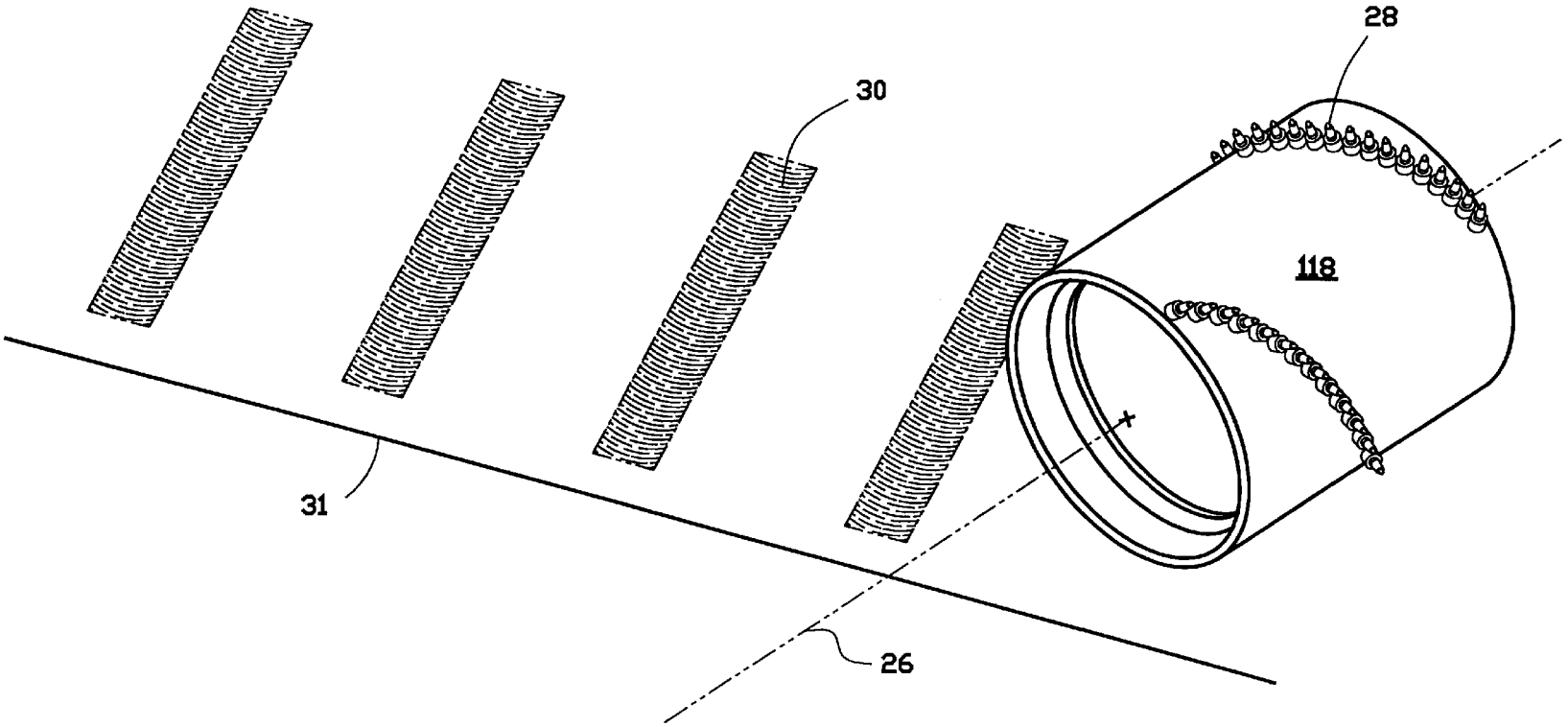
FIG. 4 is a view of an alternative embodiment of a cutting drum of the invention, wherein the cutting teeth are arranged in a mirror image of the interrupted helical pattern of FIG. 3.

An alternative embodiment of the cutting drum is illustrated in FIG. 4. In such embodiment, the preferred number of teeth, the length, diameter and rate of rotation of drum 118, the angle of axis 26, and the speed at which the machine is advanced along the roadway are selected to be the same as in the embodiment of FIG. 3. When the cutting teeth 28 are then arranged in an interrupted helical pattern which comprises a mirror image of the pattern of FIG. 3, a pattern of rumble strips will be cut into the roadway such as is illustrated in FIG. 4. In the embodiment of FIG. 4, the pattern of arrangement of the teeth and the angle of axis 26 have been selected to orient the rumble strips cut into the surface of the roadway at an angle with respect to the direction of travel of the machine of approximately 120–130°. By selecting an appropriate pattern for the teeth and an appropriate axis of rotation for the drum, an operator of the rumble strip cutting machine may drive the machine along the roadway in direction F and cut the rumble strips at any desired angle with respect to the direction of travel.

Figure 5:
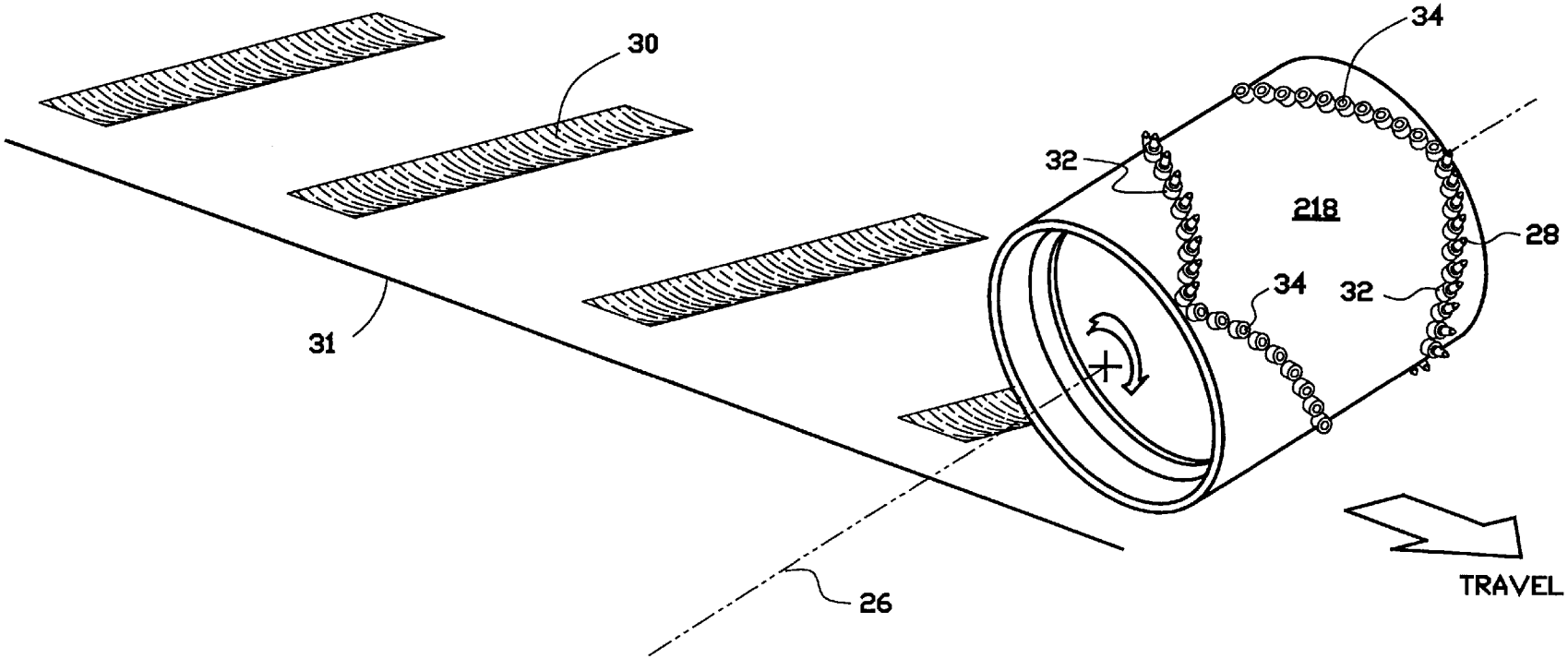
FIG. 5 is a third embodiment of a cutting drum of the invention, in which the cutting teeth may be mounted in alternative interrupted helical patterns.

A third embodiment of the cutting drum is drum 218 illustrated in FIG. 5. Drum 218 has two sets of receiving means 32 and 34 attached to the drum in two interrupted helical patterns. As shown in FIG. 5, cutting teeth 28 are mounted in receiving means 32 of drum 218 in a pattern similar to that of the teeth of drum 18 of FIG. 3. Consequently, the cutting teeth of drum 218 (as illustrated in FIG. 5) would create a rumble strip pattern in the same orientation with respect to the edge of the roadway as is created by drum 18, shown in FIG. 3. In the embodiment of FIG. 5, cutting teeth 28 can be removed from receiving means 32 and attached to receiving means 34 to create a cutting teeth pattern (and a corresponding rumble strip orientation) similar to that shown in FIG. 4.

Once the operator of machine 10 has selected and installed the desired cutting drum with its desired teeth pattern and orientation of its axis of rotation, operation of machine 10 may begin. The drive means may be engaged to rotate wheels or drive tracks to advance and maneuver machine 10. Once the machine is located in the desired position to begin cutting rumble strips, the cutting drum can be rotated, preferably in a clockwise direction, about axis 26, and lowered to a predetermined position relative to the surface of the roadway. The drive means may then be engaged to drive the machine along and across the surface of the roadway. Upon contact with the surface of the roadway, cutting teeth 28 will begin to cut or grind a series of spaced parallel rumble strips 30 into the surface of the roadway. In the preferred embodiments of the invention illustrated in the drawings, a single rotation of the cutting drum will cut a single rumble strip and continue to rotate the drum (while the machine advances) to position it for cutting of the next strip. Therefore, it is important that the size of the cutting drum, the number and pattern of arrangement of the teeth thereon, the angle and rate of rotation of the drum and the speed of advancement of the machine be selected so that the rumble strips will be spaced and oriented as desired.

The cuttings obtained from rotation of the cutting teeth into the surface of the roadway may be transferred, by rotation of cutting drum 18 and cutting teeth 28, to conveyor 20 for removal from the roadway, or the conveyor may remain idle so that the cuttings may be swept or vacuumed by brooms and/or a vacuum device (not shown). If desired, conveyor 20 may be utilized to convey the cuttings obtained from the surface of the roadway to a truck moving alongside of machine 10 to carry them away from the work site.

Once the desired rumble strips have been cut, rotation of cutting drum 18 should be disengaged and the drum raised so as to permit movement of the machine 10 without the creation of further rumble strips. After disengagement of drum 18, machine 10 may be operated in a reverse direction (opposite to direction F), if necessary. Failure to disengage and raise drum 18 prior to operating machine 10 in a reverse direction may cause damage to the drum or the cutting teeth.

Although this description contains many specifics, these should not be construed as limiting the scope of the invention but as merely providing illustrations of some of the presently preferred embodiments thereof, as well as the best mode contemplated by the inventor of carrying out the invention. The invention, as described herein, is susceptible to various modifications and adaptations, and the same are intended to be comprehended within the meaning and range of equivalents of the appended claims.

What is claimed is:

1. A self-propelled machine for cutting rumble strips in the surface of a roadway, which machine comprises:

(a) a frame;

(b) drive means mounted to the frame and adapted for advancing the machine across the surface of the roadway;

(c) a generally cylindrical cutting drum mounted on the frame for rotation about an axis that is disposed generally parallel to the surface of the roadway;

(d) a plurality of cutting teeth mounted on the outer surface of the drum;

(e) means for rotating the cutting drum about its axis;

(f) means for maintaining the drum at a predetermined position with respect to the surface of the roadway so that the cutting teeth will cut into said surface a relatively constant, predetermined depth as the drum is rotated about its axis while the machine is advanced along the surface of the roadway;

wherein the cutting teeth are arranged in a predetermined pattern around the drum so that when the drum is rotated about its axis while being maintained at said predetermined position with respect to the surface of the roadway as the machine is advanced therealong, the cutting teeth will cut a series of spaced parallel rumble strips into the surface of the roadway.

2. The machine of claim 1, wherein the cutting teeth are arranged in an interrupted helical pattern around the drum.

3. The machine of claim 1, which includes means for changing the orientation of the axis of rotation of the drum with respect to the direction of travel of the machine along the roadway, so as to change the orientation of the rumble strips with respect to the direction of travel of the machine along the roadway.

4. The machine of claim 1, which includes means for removing cuttings obtained from rotation of the cutting teeth into the surface of the roadway, and for conveying said cuttings away from the cutting drum.

5. The machine of claim 1, wherein the drum is sized and the cutting teeth are provided in sufficient number and arranged so that the rumble strips cut into the surface of the roadway are approximately five inches wide and up to 40 inches long.

6. The machine of claim 1, wherein the machine is advanced along the surface of the roadway at a first predetermined rate, and wherein the drum is sized, the cutting teeth are provided in sufficient number and arranged, and the drum is rotated at a second predetermined rate so that the rumble strips cut into the surface of the roadway are spaced approximately one foot apart.

7. The machine of claim 6, wherein the drum has a diameter of about 31.5 inches and 37 teeth are arranged thereon in an interrupted helical pattern, and wherein the drum is rotated at a rate of about 160 revolutions per minute while the machine is advanced along the roadway at a rate of about 160 feet per minute.

8. A machine for cutting a series of regularly-spaced, generally parallel depressions in the surface of a roadway, which machine comprises:

(a) a mobile chassis that is adapted for movement along the surface of a roadway;

(b) a plurality of wheels rotatably mounted to the chassis;

(c) drive means mounted to the chassis and adapted for rotating at least one of the wheels to advance the machine across the surface of the roadway at a first predetermined rate;

(d) a generally cylindrical cutting drum mounted on the chassis for rotation about an axis that is disposed generally parallel to the surface of the roadway, said drum being provided with a plurality of cutting teeth mounted on the outer surface thereof;

(e) means for rotating the cutting drum about its axis at a second predetermined rate;

(f) means for maintaining the axis of the drum at a predetermined position above and generally parallel to the surface of the roadway so that the cutting teeth will cut into said surface a relatively constant, predetermined depth as the drum is rotated about its axis while the machine is advanced along the surface of the roadway;

wherein the cutting teeth are arranged in a predetermined pattern around the drum so that when the drum is rotated about its axis at the second predetermined rate while the axis is maintained at said predetermined position with respect to the surface of the roadway as the machine is advanced therealong at the first predetermined rate, the cutting teeth will cut a series of regularly-spaced, generally parallel depressions into the surface of the roadway.

9. The machine of claim 8, wherein the cutting teeth are arranged in an interrupted helical pattern around the drum, and the axis of the drum is maintained at a predetermined position with respect to the direction of travel of the machine along the roadway so that the depressions cut into the surface of the roadway are disposed at an angle of approximately 30–40° from said direction.

10. The machine of claim 8, which includes discharge means for removing cuttings obtained from rotation of the cutting teeth into the surface of the roadway, and for conveying said cuttings away from the cutting drum.

11. A method for cutting rumble strips in the surface of a roadway, which method comprises:

(a) providing a frame of a cutting machine that is adapted for movement along the roadway;

(b) providing a generally cylindrical cutting drum that is mounted on the frame for rotation about an axis that is disposed generally parallel to the surface of the roadway;

(c) providing a plurality of cutting teeth mounted on the outer surface of the drum;

(d) arranging the cutting teeth in a predetermined pattern around the drum so that when the drum is rotated about its axis while being maintained at a predetermined position with respect to the surface of the roadway and with respect to the direction of movement of the machine along the roadway as the machine is moved in such direction, the cutting teeth will cut a series of spaced, generally parallel rumble strips at a predetermined depth into the surface of the roadway;

(e) rotating the cutting drum about its axis; while (f) moving the cutting machine across the surface of the roadway; and (g) maintaining the drum at a predetermined position with respect to the surface of the roadway and with respect to the direction of movement of the machine therealong;

so that the cutting teeth will cut into said surface a series of spaced rumble strips.

12. The method of claim 11, wherein the cutting teeth are arranged in an interrupted helical pattern around the drum.

13. The method of claim 11, which includes removing cuttings obtained from rotation of the cutting teeth into the surface of the roadway, and conveying said cuttings away from the cutting drum.

14. The method of claim 11, which includes sizing the drum, providing a sufficient number of cutting teeth and arranging said cutting teeth so that the rumble strips cut into the surface of the roadway are approximately five inches wide and up to 40 inches long.

15. The method of claim 11, which includes maintaining the drum at a predetermined position with respect to the surface of the roadway and with respect to the direction of movement of the machine along the roadway and arranging the cutting teeth so that the depressions cut into the surface of the roadway are disposed at an angle of approximately 30–40° from said direction.

16. The method of claim 11, which includes moving the cutting machine across the surface of the roadway at a first predetermined rate, sizing the drum at a predetermined diameter and rotating it at a second predetermined rate, providing the cutting teeth in a predetermined number and arranging the cutting teeth on the drum in a predetermined pattern so that the rumble strips cut into the surface of the roadway are spaced approximately one foot apart.

17. The method of claim 16, which includes providing the drum in a diameter of about 31.5 inches and with 37 teeth arranged thereon in an interrupted helical pattern, and which includes rotating the drum at a rate of about 160 revolutions per minute while advancing the machine along the roadway at a rate of about 160 feet per minute.

* * * * *